US005180083A

United States Patent [19]

Carlson

[11] Patent Number: 5,180,083

[45] Date of Patent: Jan. 19, 1993

[54] GEL DISPENSER APPARATUS FOR EXPRESSING A FLAMMABLE GEL

[76] Inventor: Michael A. Carlson, 510 Roper Rd., Eugene, Oreg. 97402

[21] Appl. No.: 751,136

[22] Filed: Aug. 28, 1991

[51] Int. Cl.[5] ..... B67D 5/06

[52] U.S. Cl. ..... 222/185; 222/212; 222/232; 366/342

[58] Field of Search ..... 222/173, 181, 184, 185, 222/206, 212, 215, 232, 236, 551; 336/130, 342

[56] References Cited

U.S. PATENT DOCUMENTS

| | | | |
|---|---|---|---|
| 1,832,798 | 11/1931 | Taylor | 222/185 X |
| 2,056,863 | 10/1936 | Napier | 222/185 |
| 2,896,926 | 7/1959 | Chapman | 366/129 X |
| 3,129,846 | 4/1964 | Van Der Lely et al. | 222/236 X |
| 3,146,919 | 9/1964 | Chappell | 222/212 |
| 4,480,926 | 11/1984 | Lattery, Jr. et al. | 366/130 X |
| 4,733,802 | 3/1988 | Sheldon | 222/181 |
| 4,737,036 | 4/1988 | Offermann | 36/130 |
| 4,872,594 | 10/1989 | Bloom | 222/173 |

*Primary Examiner*—Kevin P. Shaver
*Assistant Examiner*—Joseph A. Kaufman
*Attorney, Agent, or Firm*—Leon Gilden

[57] ABSTRACT

A flammable gel is arranged for extrusion through a nozzle of the associated container, wherein the container includes support legs pivotally mounted about a cylindrical collar secured to the container adjacent a top portion of the container, with the collar including the pivotal legs each including feet secured to the floor of the container in a first position relative to a second position, wherein the legs are projected beyond the container cap member to position the cap member for extrusion of the gel. Agitator structure is provided within the container to effect agitation of the gel for use in projecting the gel in a convenient manner to assist in a starting of fires.

2 Claims, 4 Drawing Sheets

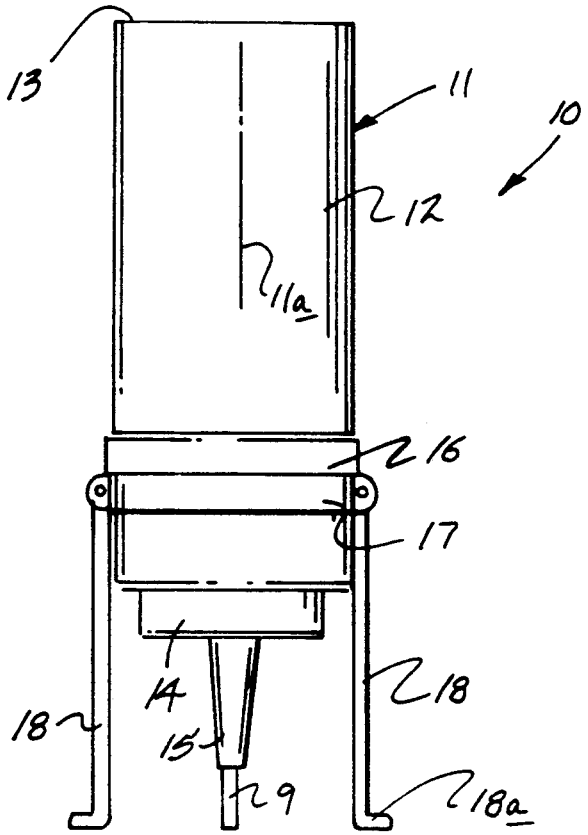
FIG. 1
FIG. 2
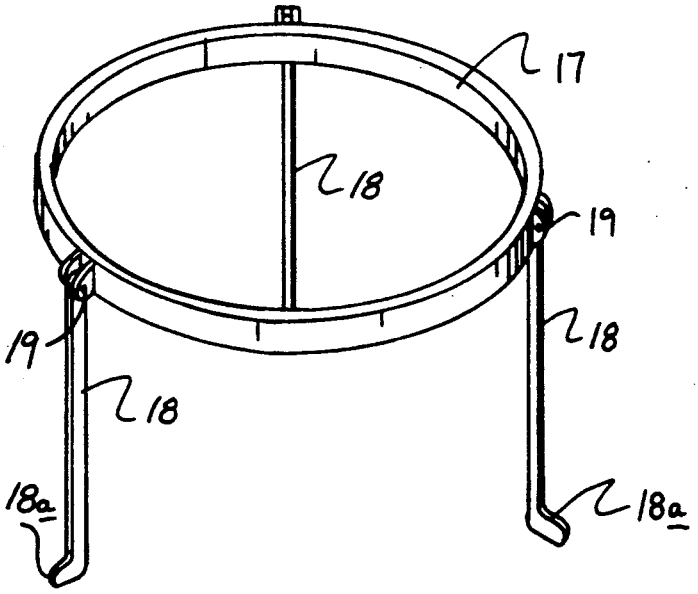

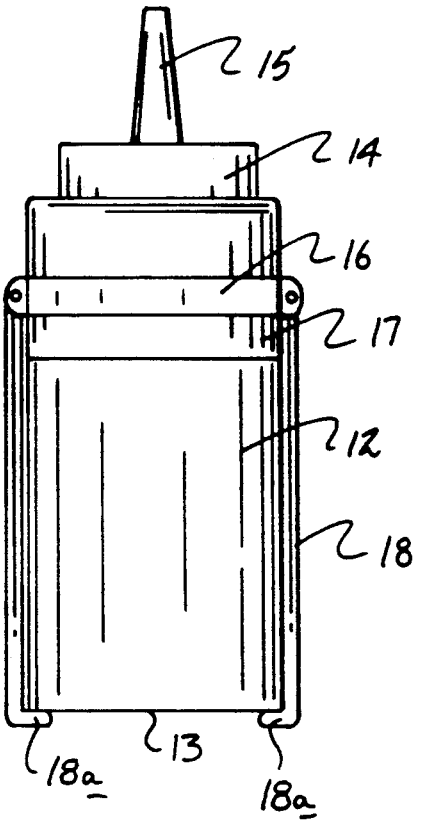
FIG 3
FIG 4
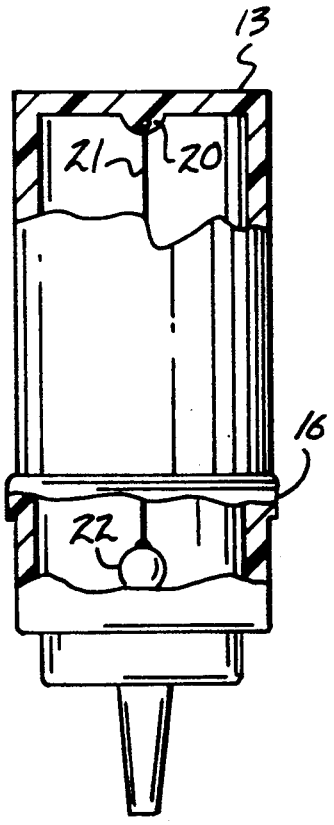

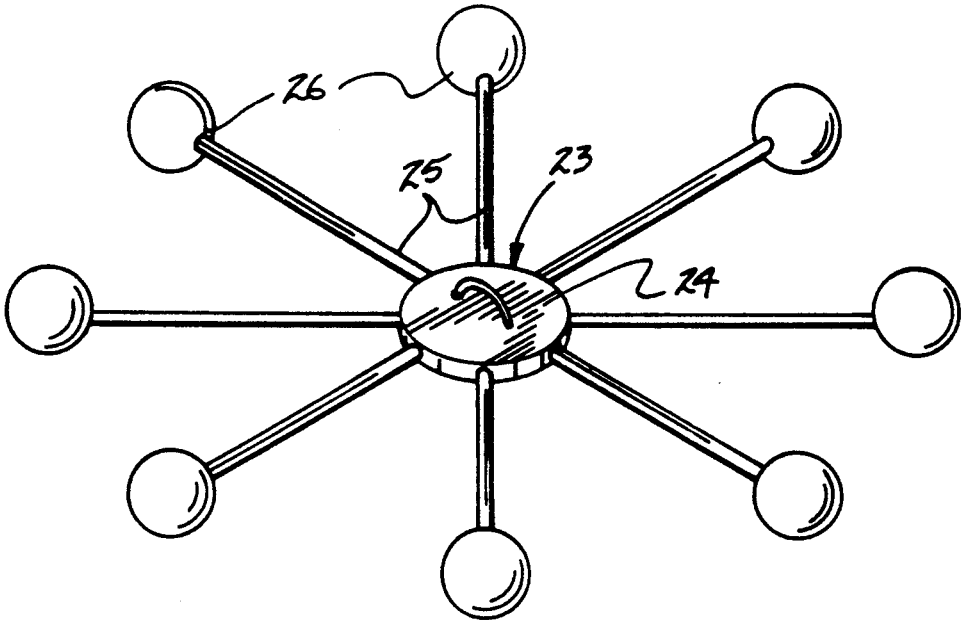
Fig 5
Fig 6
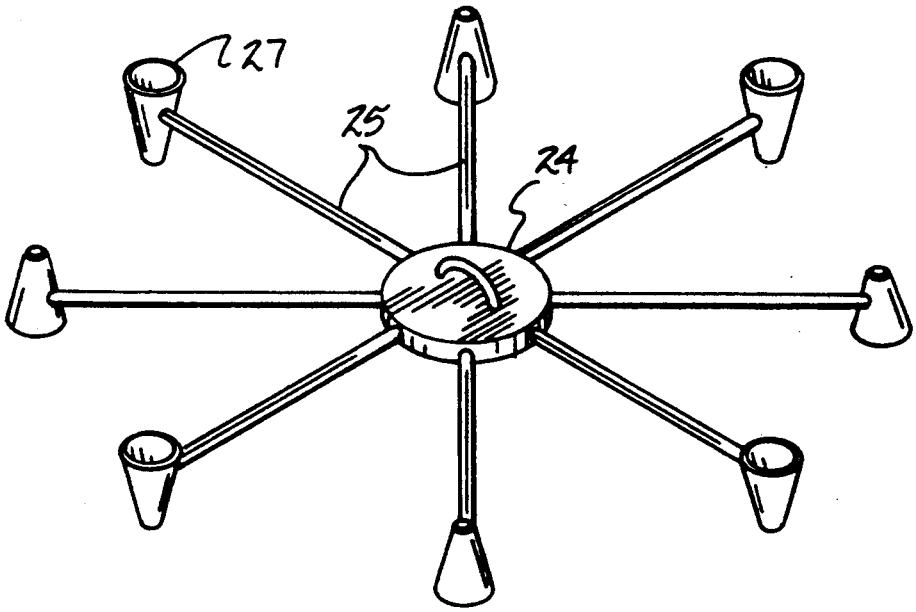

GEL DISPENSER APPARATUS FOR EXPRESSING A FLAMMABLE GEL

BACKGROUND OF THE INVENTION

1. Field of the Invention

The field of invention relates to fire starter apparatus, and more particularly pertains to a new and improved gel dispenser apparatus wherein the same is arranged to permit the ease of ignition of fires.

2. Description of the Prior Art

Fire starting materials have been utilized in the prior art to assist in the combustion process of material, such as charcoal briquettes, pellet stoves, wood burning fireplaces, and the like. Such fire starting material is exemplified in U.S. Pat. No. 4,485,584 to Raulerson, et al. utilizing an odor-free combustible cellulosic material in a liquid impregnated made up of proportions of paraffin wax, motor oil, mineral oil, and animal fat.

U.S. Pat. No. 4,382,802 to Beinke, et al. sets forth a fire starter formed with an oil and water emulsion.

U.S. Pat. No. 4,417,900 to Barthel sets forth a high-temperature solid fire starter formed in a wax matrix.

U.S. Pat. No. 3,927,993 to Griffin sets forth a fire starter utilizing particles of zirconium, hafnium, or titanium sponge bonded together under high pressure into a binder to form a cake or pellet.

U.S. Pat. No. 4,698,068 to Jensen sets forth a fire starter utilizing a rod and ignitable material, such as magnesium and includes a pyrophoric element adhered to the rod along its length to enhance its ignition.

As such, it may be appreciated that there continues to be a need for a new and improved gel dispenser apparatus as set forth by the instant invention which addresses both the problems of ease of use as well as effectiveness in construction in permitting the convenient starting of fires as required and in this respect, the present invention substantially fulfills this need.

SUMMARY OF THE INVENTION

In view of the foregoing disadvantages inherent in the known types of fire starter apparatus now present in the prior art, the present invention provides a gel dispenser apparatus wherein the same utilizes a flammable non-explosive gel contained within a squeeze container. As such, the general purpose of the present invention, which will be described subsequently in greater detail, is to provide a new and improved gel dispenser apparatus which has all the advantages of the prior art fire starter apparatus and none of the disadvantages.

To attain this, the present invention provides a flammable gel arranged for extrusion through a nozzle of the associated container, wherein the container includes support legs pivotally mounted about a cylindrical collar secured to the container adjacent a top portion of the container, with the collar including the pivotal legs each including feet secured to the floor of the container in a first position relative to a second position, wherein the legs are projected beyond the container cap member to position the cap member for extrusion of the gel. Agitator structure is provided within the container to effect agitation of the gel for use in projecting the gel in a convenient manner to assist in a starting of fires.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gel dispenser apparatus which has all the advantages of the prior art fire starter apparatus and none of the disadvantages.

It is another object of the present invention to provide a new and improved gel dispenser apparatus which may be easily and efficiently manufactured and marketed.

It is a further object of the present invention to provide a new and improved gel dispenser apparatus which is of a durable and reliable construction.

An even further object of the present invention is to provide a new and improved gel dispenser apparatus which is susceptible of a low cost of manufacture with regard to both materials and labor, and which accordingly is then susceptible of low prices of salt to the consuming public, thereby making such gel dispenser apparatus economically available to the buying public.

Still yet another object of the present invention is to provide a new and improved gel dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view, taken in elevation, of a gel dispenser apparatus utilized by the instant invention to dispense a fire starter gel therefrom.

FIG. 2 is an isometric illustration of the support collar utilized by the invention.

FIG. 3 is an orthographic view of the invention in a first position relative to the second position of FIG. 1.

FIG. 4 is an orthographic view, partially in section, of the container of the invention.

FIG. 5 is an isometric illustration of a further agitator means utilized by the invention.

FIG. 6 is an isometric illustration of a yet further agitator means utilized by the invention.

DESCRIPTION OF THE PREFERRED EMBODIMENT

Figure 7:
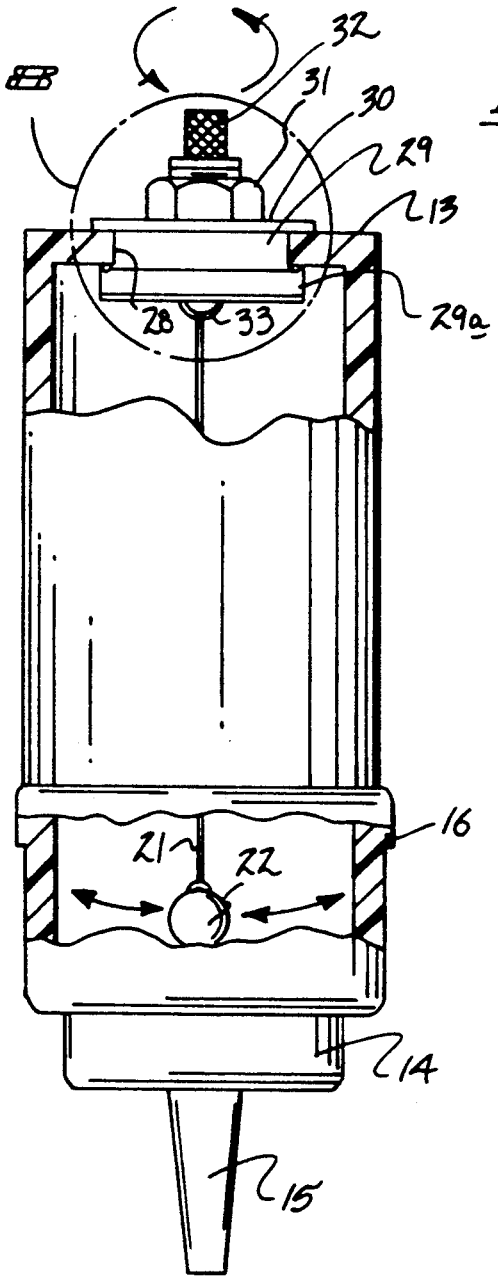
FIG. 7 is an orthographic view, partially in section, of a modified agitator stator structure utilized by the container.

With reference now to the drawings, and in particular to FIGS. 1 to 8 thereof, a new and improved gel dispenser apparatus embodying the principles and concepts of the present invention and generally designated by the reference numeral 10 will be described.

The instant invention is directed to gel material in that class of material to permit the ease of combustion of various components such as wood, charcoal briquettes, and the like. To this end, a water soluble gum, such as Methocel®, is arranged to include a mixture of wood alcohol and ammonia arranged in various proportions as an example of a fire starter structure, wherein in alternatively a wax or paraffin binder may be employed as exemplified in U.S. Pat. No. 4,417,900 incorporated herein by reference.

The dispenser structure 10 is utilized by the invention to permit expressing of the flammable gel 9, as illustrated in FIG. 1, and includes a cylindrical container 11 formed of a flexible shape-retentive material defined along an axis 11*a* to include a cylindrical side wall 12, a floor 13, and a top wall mounting a cap member 14. The cap member 14 and an associated conical nozzle 15 are coaxially aligned along the axis 11*a*. A cylindrical abutment flange 16 is integrally formed to the cylindrical side wall 12 proximate the top wall and fixedly mounts a cylindrical collar 17 mounted in abutment to the cylindrical flange 16 between the flange 16 and the top wall. The cylindrical collar 17 includes a plurality of support legs 18 to include at least three such legs equally spaced about the collar and pivotally mounted thereto about a pivot axle 19, wherein the pivot axle 19 is positioned radially beyond the collar 17 and the flange 16 to each mount a leg 18. Each leg 18 includes a support leg foot 18*a* orthogonally oriented relative to the leg, wherein the leg is defined by a predetermined spacing from the foot 18*a* to the pivot 19, wherein that spacing is equal to a spacing defined between the pivot 19 to the floor 13 to permit engagement of each of the support leg feet 18*a* to the floor 13 (see FIG. 3) during storage and transport of the organization.

The floor 13 includes a support pivot 20 mounted to the floor interiorly of the container 11 coaxially aligned along the axis 11*a* mounting a tether rod 21. The tether rod 21 includes an agitator sphere 22 mounted at a distal end of the tether rod spaced from the pivot 20. FIG. 5 illustrates an agitator assembly 23 that may be utilized in lieu of the agitator sphere 22, wherein the assembly 23 includes a central coaxially positioned mounting plate 24 fixedly mounting a plurality of radial legs 25 extending exteriorly of the mounting plate in a single plane, with each radial leg 25 mounting a leg agitator sphere 26 at a distal end of each radial leg 25. Alternatively, as illustrated in FIG. 6, conical funnel agitators 27 are utilized, wherein the funnel agitators are in a first and second orientation defined by alternatively the base or the conical tip positioned downwardly relative to the floor 18 when mounted to the lower terminal end of the tether rod 21. In this manner, the alternating configurations, as illustrated in FIG. 6, enhance agitation within the container 11 while permitting the gel to be directed through each of the funnel agitators 27.

Figure 8:
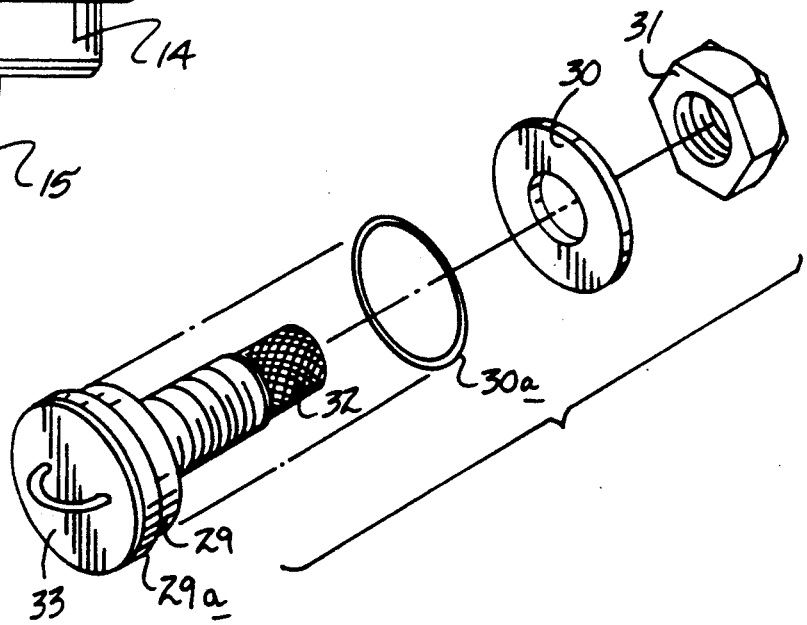
FIG. 8 is an isometric exploded illustration of the agitator support structure.

The FIGS. 7 and 8 illustrate an alternative manner of mounting the tether rod 21 to permit its selective rotation to include the floor 13 formed with a floor aperture directed coaxially therethrough receiving an aperture collar 29. The aperture collar 29 is captured within the aperture 28 between a collar flange 29*a* within the container adjacent and contiguous to the floor aperture 28 in surrounding relationship relative to the collar 29, with a capture flange 30 positioned exteriorly of the floor 13, with the capture flange 30 optionally utilizing a bearing ring 30*a*, as illustrated in FIG. 8, to enhance ease of rotation of the aperture collar 29 by use of the knurled shank 32 projecting coaxially beyond the floor 13 exteriorly of the container utilizing a fastener 31 mounted below the knurled shank 32 between the capture flange 30 and the knurled shank. The support ring 33, as illustrated in the FIGS. 7 and 8, are mounted coaxially to a bottom surface of the collar flange 29*a* and mounts the upper terminal end of the tether rod 21. In this manner, rotation of the tether rod is permitted by rotation of the knurled shank 32 within the floor aperture 28. Specifically when utilizing the agitator assembly 23, as illustrated in the FIGS. 5 and 6, the rotation of the tether rod 21 provides effective agitation and mixture of the composition within the container 11 for its subsequent expressing through the nozzle 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gel dispenser apparatus for expressing a flammable gel comprises, a cylindrical container, the cylindrical container formed of a flexible shape-retentent material defined along an axis, and the cylindrical container including a cylindrical side wall, a planar floor mounted to a first end of the cylindrical side wall, and a top wall, and a cap member mounted to the top wall, with the cap member including a nozzle to permit expressing of the gel therethrough, and mounting means for selectively mounting the cylindrical container in a vertical orientation, and the mounting means includes a cylindrical abutment flange integrally mounted to the cylindrical side wall adjacent the top wall, wherein the abutment flange includes a cylindrical collar mounted to the cylindrical side wall in abutment with the cylindrical flange between the cylindrical flange and the top wall, and the cylindrical collar including a plurality of leg pivots mounted to the cylindrical collar extending radially beyond the cylindrical collar and the abutment flange, and each leg pivot including a support leg pivotally mounted to each pivot, each support leg defined by a predetermined length, the predetermined length substantially equal to a length defined between the leg pivot and the floor, and each support leg including a support leg foot orthogonally and integrally mounted to each distal end of each support leg spaced from each leg pivot, wherein each support leg is arranged in a first position extending beyond the nozzle and pivotal to a second position, wherein each support leg foot is in engagement with the floor, and the floor includes a support pivot, the support pivot mounted to the floor interiorly of the container coaxially aligned with the axis, and the support pivot including a tether rod, the tether rod mounting an agitator member at a distal end of the tether rod spaced from the support pivot, and the agitator member includes a mounting plate, the mounting plate including a plurality of radial legs arranged in a single plane, wherein each of the radial legs include an agitator sphere mounted to each radial leg at a distal end of each radial leg spaced from the mounting plate.

2. An apparatus as set forth in claim 1 wherein the support pivot is fixedly mounted to a collar flange, the collar flange includes a collar coaxially mounted to the collar flange positioned interiorly of the collar flange, and the floor including a floor aperture, with the collar complementarily received within the floor aperture, and the collar flange positioned within the container in contiguous communication with the floor, and the collar including a shank extending coaxially of the collar through the floor aperture and extending beyond the floor exteriorly of the container, and the shank including a capture flange mounted in surrounding relationship relative to the shank to an exterior surface of the floor, with a fastener mounted in contiguous communication with the capture flange about the shank to secure the capture flange in contiguous communication with the floor to secure the collar within the floor aperture, and the shank including a knurled shank portion extending beyond the fastener permitting rotation of the knurled shank and the collar within the floor aperture to permit rotation of the agitator member within the container.

* * * * *